US005870908A

United States Patent [19]

Rushlow

[11] Patent Number: 5,870,908

[45] Date of Patent: Feb. 16, 1999

[54] LOAD BALANCING DEVICE

[76] Inventor: Paul S. Rushlow, 810 Kennesaw, Forest Park, Ga. 30050

[21] Appl. No.: 933,426

[22] Filed: Sep. 18, 1997

[51] Int. Cl.[6] ..... D06F 37/24

[52] U.S. Cl. ..... 68/23.2; 74/573 R; 74/573 F

[58] Field of Search ..... 68/23.2; 74/573 R, 74/573 F; 301/5.22

[56] References Cited

U.S. PATENT DOCUMENTS

| | | | |
|---|---|---|---|
| 3,191,997 | 6/1965 | Colvert | 74/573 R X |
| 3,321,997 | 5/1967 | Peterson | 301/5.22 X |
| 3,494,471 | 2/1970 | Grippo | 74/573 R X |
| 3,733,923 | 5/1973 | Goodrich et al. | 301/5.22 X |
| 4,388,841 | 6/1983 | Gamble | 301/5.22 X |
| 4,432,253 | 2/1984 | Kerlin | 74/573 R |
| 5,048,367 | 9/1991 | Knowles | 301/5.22 X |
| 5,142,936 | 9/1992 | McGale | 301/5.22 X |

FOREIGN PATENT DOCUMENTS

| | | | |
|---|---|---|---|
| 1461796 | 2/1989 | U.S.S.R. | 68/23.2 |

*Primary Examiner*—Philip R. Coe

[57] ABSTRACT

A new load balancing device for correcting a load imbalance in a rotating member such as a spin basket in a wash machine. The inventive device includes a tube member in a circular configuration with a fluid and spherical ballast members provided within the hollow interior of the tube member.

16 Claims, 2 Drawing Sheets

LOAD BALANCING DEVICE

BACKGROUND OF THE INVENTION

1. Field of the Invention

The present invention relates to balancing devices for rotating members and more particularly pertains to a new load balancing device for correcting a load imbalance in a rotating member such as a spin basket in a wash machine.

2. Description of the Prior Art

The use of balancing devices for rotating members is known in the prior art. More specifically, balancing devices for rotating members heretofore devised and utilized are known to consist basically of familiar, expected and obvious structural configurations, notwithstanding the myriad of designs encompassed by the crowded prior art which have been developed for the fulfillment of countless objectives and requirements.

Known prior art balancing devices for rotating members include U.S. Pat. Nos. 4,044,626; 4,646,545; 4,388,841; 5,211,038; 4,517,695; and 5,231,857.

While these devices fulfill their respective, particular objectives and requirements, the aforementioned patents do not disclose a new load balancing device. The inventive device includes a tube member in a circular configuration with a ballast means provided within the hollow interior of the tube member. Preferably, the ballast means includes a fluid and spherical ballast members.

In these respects, the load balancing device according to the present invention substantially departs from the conventional concepts and designs of the prior art, and in so doing provides an apparatus primarily developed for the purpose of correcting a load imbalance in a rotating member such as a spin basket in a wash machine.

SUMMARY OF THE INVENTION

In view of the foregoing disadvantages inherent in the known types of balancing devices for rotating members now present in the prior art, the present invention provides a new load balancing device construction wherein the same can be utilized for correcting a load imbalance in a rotating member such as a spin basket in a wash machine.

The general purpose of the present invention, which will be described subsequently in greater detail, is to provide a new load balancing device apparatus and method which has many of the advantages of the balancing devices for rotating members mentioned heretofore and many novel features that result in a new load balancing device which is not anticipated, rendered obvious, suggested, or even implied by any of the prior art balancing devices for rotating members, either alone or in any combination thereof.

To attain this, the present invention generally comprises a tube member in a circular configuration with a ballast means provided within the hollow interior of the tube member. Preferably, the ballast means includes a fluid and spherical ballast members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new load balancing device apparatus and method which has many of the advantages of the balancing devices for rotating members mentioned heretofore and many novel features that result in a new load balancing device which is not anticipated, rendered obvious, suggested, or even implied by any of the prior art balancing devices for rotating members, either alone or in any combination thereof.

It is another object of the present invention to provide a new load balancing device which may be easily and efficiently manufactured and marketed.

It is a further object of the present invention to provide a new load balancing device which is of a durable and reliable construction.

An even further object of the present invention is to provide a new load balancing device which is susceptible of a low cost of manufacture with regard to both materials and labor, and which accordingly is then susceptible of low prices of sale to the consuming public, thereby making such load balancing device economically available to the buying public.

Still yet another object of the present invention is to provide a new load balancing device which provides in the apparatuses and methods of the prior art some of the advantages thereof, while simultaneously overcoming some of the disadvantages normally associated therewith.

Still another object of the present invention is to provide a new load balancing device for correcting a load imbalance in a rotating member such as a spin basket in a wash machine.

Yet another object of the present invention is to provide a new load balancing device which includes a tube member in a circular configuration with a ballast means provided within the hollow interior of the tube member. Preferably, the ballast means includes a fluid and spherical ballast members.

Still yet another object of the present invention is to provide a new load balancing device that is ready for use by simply being placed within a rotating member such as a spin basket in a washing machine.

Even still another object of the present invention is to provide a new load balancing device that is expandable so that one load balancing device may be used with a variety of sizes of washing machines.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
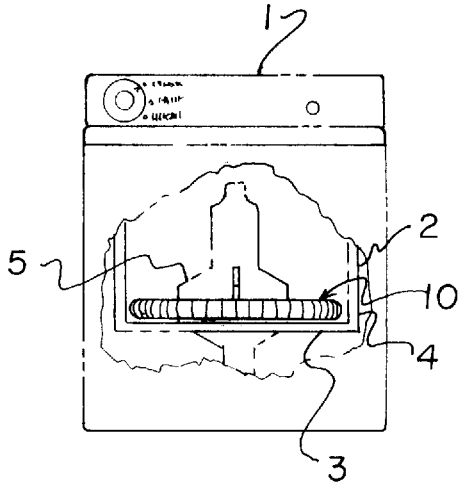
FIG. 1 is a partial breakaway view of a new load balancing device according to the present invention in use in a washing machine.

With reference now to the drawings, and in particular to FIGS. 1 through 4 thereof, a new load balancing device embodying the principles and concepts of the present invention and generally designated by the reference numeral 10 will be described.

As best illustrated in FIGS. 1 through 4, the invention comprises a load balancing device 10 for installing in a rotating member such as a spin basket 2 of a centrifugal type washing machine 1. The load balancing device 10 comprises a tube member 20 in a circular configuration. The tube member 20 has an interior surface 22 that defines a hollow interior 23. A ballast means 30 is provided within the hollow interior 23.

Figure 2:
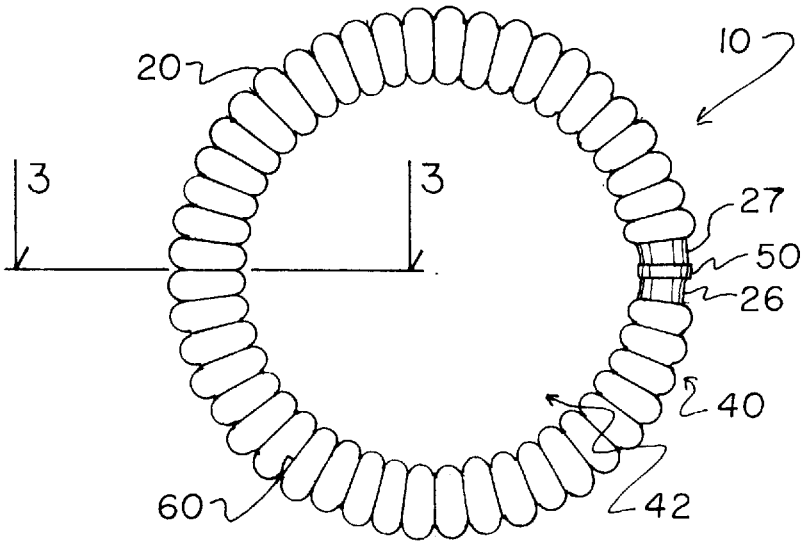
FIG. 2 is a top view of the present invention.

As shown in FIG. 2, the tube member 20 is in a circular configuration such that it forms a load ring 40. The load ring 40 defines a central opening 42. Preferably, the outer diameter of the load ring 40 substantially corresponds to the outer diameter of the rotating member to be balanced.

Figure 4:
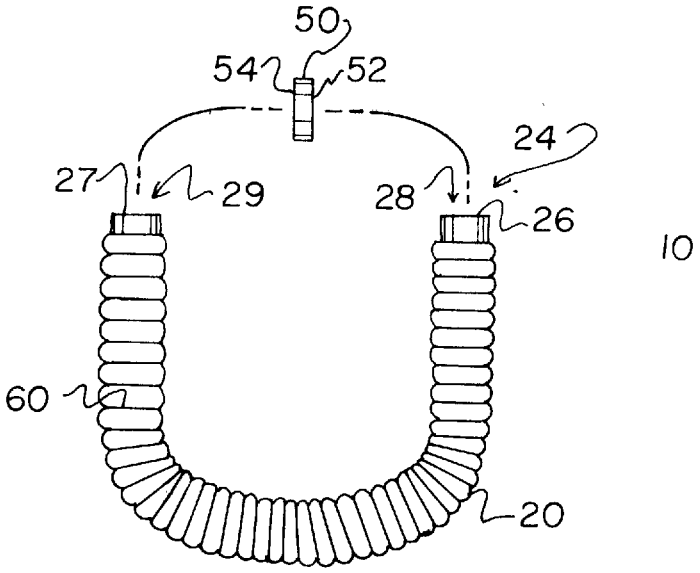
FIG. 4 is a top view of the present invention in a disassembled state.

Preferably, as shown in FIG. 4, the tube member 20 is elongate and flexible. The tube member 20 has a break 24 which forms an open first end 26 with a first end opening 28 and an open second end 27 with a second end opening 29. The first end 26 and second end 27 are in fluid communication with each other as well as detachably coupled together so that the tube member 20 is in a circular configuration to form the load ring 40. Ideally, the first end 26 and the second end 27 are detachably coupled together so that the first end opening 28 is in fluid communication with the second end opening 29.

As illustrated in FIGS. 2 and 4, a coupler member 50 may be used to detachably couple the first and second ends 26, 27 together to facilitate removal and changing of the ballast means 30. In such an embodiment, the coupler member 50 has a first side 52, a second side 54, and an interior bore (not shown) extending through it between the coupler member first side 52 and second side 54. The first end 26 of the tube member 20 is inserted into the interior bore (not shown) of the coupler member 50 from the coupler member first side 52. Likewise, the second end 27 of the tube member 20 is inserted into the interior bore of the coupler member 50 from the coupler member second side 54. Ideally, the inner diameter of the coupler member interior bore is substantially equivalent to the inner diameter of the tube member 20 so that the ballast means 30 may move freely between the tube member end openings 28, 29 through the interior bore.

Preferably, the tube member 20 has a plurality of spaced apart ribs 60. Each pair of adjacent ribs 60 defines a cell portion (not shown) between them. Also preferably, the ribs 60 extend radially inward from the interior surface 22 of the tube member 20 into the tube member hollow interior 23. The cell portions in combination with the portions of the ribs 60 that extend into the hollow interior 23 help collect and hold the ballast means 30 in a spread out manner within the tube member hollow interior 23 for a distribution of the ballast that provides a better balancing effect. Ideally, the ribs 60 are arranged along the length of the tube member 20 between the first end 26 and the second end 27 of the tube member 20.

In a preferred embodiment, the tube member 20 is extendible along its length between the tube member first and second ends 26, 27. Such extendibility permits the load balancing device 10 to be used in rotating members such as spin baskets 2 of varying diameters. For example, when used in a spin basket 2 which has a larger diameter than the load ring 40, the tube member 20 stretches out to abut the washing machine side wall 4. Thus, the load balancing device 10 is very versatile and needs no attaching means for use.

Also in the preferred embodiment, the outer diameter of the tube member 20 is between about ¾ inch and about 1½ inches to be easily placed in and removed from a washing machine without reducing the capacity of the spin basket excessively. Optionally, larger or smaller diameters may be used.

Figure 3:
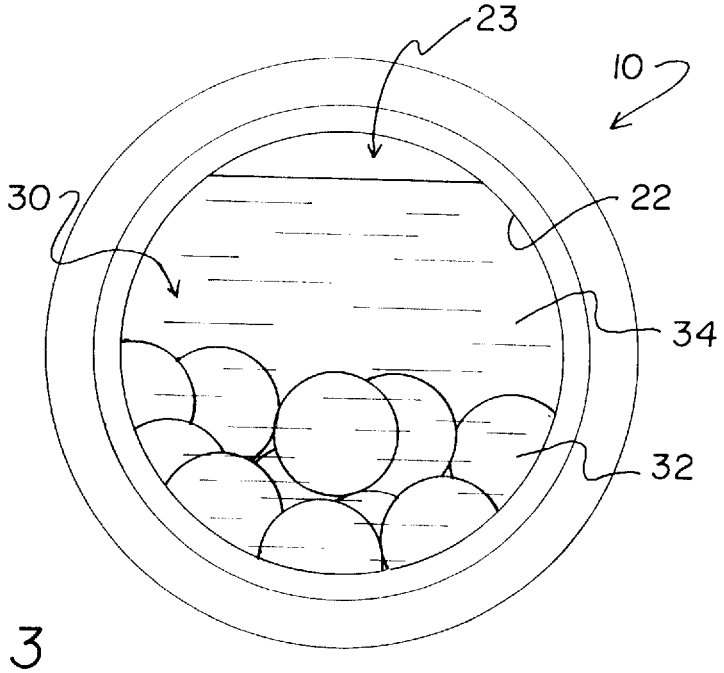
FIG. 3 is a cross sectional view of the present invention taken along line 3—3 in FIG. 2 particularly illustrating the ballast means.

Preferably, the ballast means 30 includes a plurality of ballast members 32 disposed within the hollow interior 23 of the tube member 20. Ideally, as illustrated in FIG. 3, the ballast members 32 are spherical for easier movement through the tube member hollow interior 23. Also ideally, the ballast members 32 comprise metal spheres. Most ideally the ballast members 32 comprise steel bearings of about ⅛ inch to about ¾ inch in diameter for relatively free movement through a tube member 20 of the most preferred outer diameter.

Also preferably, the ballast means 30 includes a volume of fluid 34 provided within the hollow interior 23 of the tube member 20 to act as a suspension medium for the ballast members 32 to aid in their distribution. Ideally, as shown in FIG. 3, the volume of fluid 34 substantially fills the remainder volume of the tube member hollow interior 23. The preferred fluid 34 includes mineral oil intestinal lubricant because it helps the bearings "float" into a balancing position as well as is clear, odorless, and biodegradable, thus not staining clothes or harming the environment if spilled. Furthermore, the mineral oil acts as a lubricant to help the ballast members 32 pass over one another during use. As an example, mineral oil such as that marketed under the trade name "Squibb Mineral Oil" may be used.

In the preferred embodiment, the ballast means 30 comprises about five to fifteen ½ inch steel bearings placed in the tube member hollow interior 23 with the remainder of the space within the hollow interior 23 being filled with mineral oil. In an optional embodiment, the hollow interior is filled about ⅓ to ½ way with steel bearings of the size commonly referred to as "BB's" with mineral filling the remainder of the tube member hollow interior 23.

In one manner of use, a centrifugal type washing machine 1 with a spin basket 2 having a bottom wall 3, a side wall 4 extending from the outer perimeter of the bottom wall 3, and an agitator 5 extending into the spin basket 2 from the spin basket bottom wall 3 is provided. Referring to FIG. 1, the load balancing device 10 in a circular configuration is placed on the bottom wall 3 of a washing machine spin basket 2 having the washing machine agitator 5 extending through the central opening 42 of the load ring 40. The washing machine 1 is used as normal. When a spin cycle is reached, the tube member 20, being extendible, extends radially outward until it abuts the side wall 4 of the spin basket 2. As the spin basket 2 is rotated, the mass of clothing being spun out may not be evenly distributed along the side wall 4 of the spin basket 2. In such case, centrifugal force causes the spherical ballast members 32 to move to oppose the heavier part of the unbalanced load and equalize it. Thus, the spin basket 2 remains in balance and vibration is minimized.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A load balancing device for installing in a spin basket of a centrifugal type washing machine, comprising:

a tube member having an interior surface defining a hollow interior, said tube member being in a circular configuration to form a load ring, said load ring defining a central opening;

a ballast means being provided within said tube member hollow interior;, said tube member having an exterior surface, said exterior surface of said tube member having a plurality of spaced apart annular constrictions therearound;

said circular configuration of said tube member having a circumference;

each of said annular constrictions lying in a plane generally perpendicular to said circumference of said circular configuration of said tube member;

said tube member having a diameter transverse said circumference of said circular configuration of said tube member; and said diameter of said tube member narrowing at each of said annular constrictions, said annular constrictions being for enhancing said flexing of said tube member in a direction transverse said circumference of said circular configuration of said tube member.

2. The load balancing device of claim 1, wherein said tube member has a break, said break forming an open first end and a open second end, said tube member first end being in fluid communication with said tube member second end.

3. The load balancing device of claim 2, wherein said tube member first end is coupled to said tube member second end to form said tube member into said load ring.

4. The load balancing device of claim 3, wherein said tube member first end is detachably coupled to said tube member second end.

5. The load balancing device of claim 2, further comprising a coupler member having a first side and a second side, and an interior bore extending therethrough between said coupler member first side and said coupler member second side, said tube member first end being inserted into said coupler member interior bore from said coupler member first side, said tube member second end being inserted into said coupler member interior bore from said coupler member second side.

6. The load balancing device of claim 2, wherein said tube member is elongate, said tube member having a plurality of spaced apart ribs being arranged along the length of said tube member between said tube member first end and said tube member second end, each pair of adjacent said ribs defining a cell portion therebetween.

7. The load balancing device of claim 6, wherein said tube member is extendible along its length between said tube member first end and said tube member second end.

8. The load balancing device of claim 1, wherein said tube member has a plurality of spaced apart ribs, each pair of adjacent said ribs defining a cell portion therebetween.

9. The load balancing device of claim 8, wherein said ribs are extended radially inwards into said tube member hollow interior from said tube member interior surface.

10. The load balancing device of claim 1, wherein said ballast means includes a plurality of ballast members being disposed within said tube member hollow interior.

11. The load balancing device of claim 10, wherein said ballast members are spherical.

12. The load balancing device of claim 10, wherein said ballast means includes a volume of fluid being provided within said tube member hollow interior.

13. The load balancing device of claim 12, wherein said volume of fluid substantially fills a remainder volume of said tube member hollow interior.

14. The load balancing device of claim 1, wherein said ballast means includes a volume of fluid being provided within said tube member hollow interior.

15. A load balancing device for installing in a spin basket of a centrifugal type washing machine, said spin basket having a bottom wall, a side wall being extended from the outer perimeter of said bottom wall, and an agitator being extended into said spin basket from said spin basket bottom wall, said load balancing device comprising:

an elongate flexible tube member having an interior surface, a first end and a second end, a plurality of spaced apart ribs, said interior surface defining a hollow interior, said ribs being arranged along the length of said tube member between said first end and said second end, said ribs being extended radially inwards into said tube member hollow interior from said tube member inner surface, each pair of adjacent said ribs defining a cell portion therebetween, said first end having an opening into said tube member hollow interior, said second end having an opening into said tube hollow interior;

a coupler member having a first side and a second side, and an interior bore extending therethrough between said first side and said second side, said tube member first end being inserted into said coupler member interior bore from said coupler member first side, said tube member second end being inserted into said coupler member interior bore from said coupler member second side to form said tube member into a load ring, said load ring defining a central opening, said tube member first end opening being in fluid communication with said tube member second end opening;

a plurality of spherical ballast members being disposed within said tube member hollow interior;

a volume of fluid being provided within said tube member hollow interior, said volume of fluid substantially filling a remainder volume of said tube member hollow interior; and wherein said load ring is for disposing within a spin basket of a centrifugal type washing machine, said load ring being for resting on the bottom wall of a spin basket, said load ring being for positioning towards the outer perimeter of the spin basket bottom wall adjacent the side wall of a spin basket, said load ring central opening being for extending an agitator therethrough.

16. The load balancing device of claim 1, wherein said tube member has a plurality of spaced apart annular ribs extending radially inwards into said tube member hollow interior from said tube member interior surface, each pair of adjacent said ribs defining a cell portion therebetween, wherein each of said annular constrictions is associated with a corresponding rib, and wherein each constriction generally lies in a common plane with the associated rib.

* * * * *